US006688548B2

(12) United States Patent
Hashimoto

(10) Patent No.: US 6,688,548 B2
(45) Date of Patent: Feb. 10, 2004

(54) PAPER ROLL DRIVING APPARATUS

(75) Inventor: Teruo Hashimoto, Kawasaki (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 3 days.

(21) Appl. No.: 10/013,113

(22) Filed: Dec. 6, 2001

(65) Prior Publication Data

US 2002/0139893 A1 Oct. 3, 2002

(30) Foreign Application Priority Data

Mar. 29, 2001 (JP) ..... 2001-094898

(51) Int. Cl.[7] ..... B65H 16/10
(52) U.S. Cl. ..... 242/564.5
(58) Field of Search ..... 242/564, 564.5, 242/559, 559.1, 559.2, 596.5, 555, 555.3, 555.5, 555.7, 554.6, 554.3

(56) References Cited

U.S. PATENT DOCUMENTS

| | | | | | |
|---|---|---|---|---|---|
| 1,973,363 | A | * | 9/1934 | Wood | 242/554.6 |
| 2,085,889 | A | * | 7/1937 | Ball | |
| 2,203,607 | A | * | 6/1940 | Wood | 242/554.3 |
| 2,638,281 | A | * | 5/1953 | Tollison | 242/554.3 |
| 2,983,458 | A | * | 5/1961 | Flannery | 242/554.6 |
| 2,997,248 | A | * | 8/1961 | Chase et al. | 242/554.3 |
| 3,098,618 | A | * | 7/1963 | Chase et al. | 242/555.7 |
| 3,388,874 | A | * | 6/1968 | Kishioka | 242/554.6 |
| 3,391,877 | A | * | 7/1968 | Angell et al. | 242/554.6 |
| 5,289,984 | A | | 3/1994 | Sohma | 242/554.3 |

FOREIGN PATENT DOCUMENTS

| | | |
|---|---|---|
| DE | 436610 | 10/1935 |
| JP | 63-48785 | 9/1988 |
| JP | 6-78136 | 10/1994 |

* cited by examiner

*Primary Examiner*—William A. Rivera
(74) *Attorney, Agent, or Firm*—McGlew and Tuttle, P.C.

(57) ABSTRACT

A paper roll driving apparatus for use in a paper roll feeding apparatus comprises a prime mover moving mechanism being freely reciprocally movable along a guide rail and having a moving body on which a prime mover is mounted, and a driving transmission mechanism comprising a relay shaft provided on the moving body so as to be in parallel to the rotating shaft and rotatable, an arm mounted on the moving body so as to be pivotable around the axial center of the relay shaft and driven by the prime mover at least via the relay shaft, and a driving transmission mechanism having a pivoting means for pivoting the arm at a predetermined angle; wherein both the prime mover and the driving transmission mechanism being adapted so as to be integrally movable with respect to the paper roll support in parallel with the rotating shaft.

4 Claims, 4 Drawing Sheets

PAPER ROLL DRIVING APPARATUS

BACKGROUND OF THE INVENTION

1. Field of the Invention

The present invention refers generally to a paper roll driving apparatus, and more particularly to a paper roll driving apparatus for use in a paper roll feeding apparatus that supports a plurality of paper rolls, continuously feeds a paper web by sequentially splicing paper rolls as the paper web is consumed in the course of printing operation, and is adapted to feed paper rolls of different widths; the paper roll driving unit for driving and rotating a new paper roll supported at a paper roll splicing position at which a paper roll is spliced to the paper web.

2. Description of the Related Art

Examples of paper roll driving apparatuses for driving and rotating a paper roll supported in a paper roll feeding apparatus that supports a plurality of paper rolls and continuously feed a paper web by sequentially splicing new paper rolls to the paper web as the paper web is consumed include the two apparatuses disclosed in Japanese Published Examined Patent Application No. Sho-63(1988)-48785 and the one disclosed in Japanese Published Examined Patent Application No. Hei-6(1994)-78136.

The first apparatus disclosed in Japanese Published Examined Patent Application No. Sho-63(1988)-48785 comprises a paper roll supporting device that can support both sides of a paper roll via supporting members having a driven accelerating roller (or a driven accelerating gear) and is supported by a rotating shaft movably along with the rotating shaft and rotatably together with the rotating shaft, a rack having a paper roll driving motor mounted thereon; the rack being supported by a guide rod and a rack shaft, both provided in parallel with the rotating shaft; adapted so that the rack can be moved along the guide rod and the rack shaft by rotating by an operating handle a pinion meshed with a rack on the rack shaft; and a new paper roll accelerating device comprising an arm having at the free end thereof a driving accelerating roller (or a driving accelerating gear) that is adapted so that the arm can pivot around the axial center of the shaft thereof at a predetermined angle, and an air cylinder for pivoting the arm at a predetermined angle; the first paper roll driving apparatus being adapted to drive the paper roll via the supporting members by causing the rack to move along the guide rod and the rack shaft by rotating the pinion by the operating handle while supporting the paper roll by causing the paper roll supporting device to move along the rotating shaft in accordance with the width and the loading position of the paper roll, and operating the new paper roll accelerating device by matching the position of the new paper roll accelerating device with the position of the driven accelerating roller (or driven accelerating gear) that has been moved as a result of the movement of the paper roll supporting device and bringing the driving accelerating roller (or driving accelerating gear) and the driven accelerating roller (or driven accelerating gear) into contact (or into mesh) with each other.

The second apparatus disclosed in Japanese Published Examined Patent Application No. Sho-63(1988)-48785 comprises a paper roll supporting device supported by the rotating shaft thereof rotatably along with the rotating shaft and movably in the axial direction of the rotating shaft for supporting a paper roll via supporting members, a rack mounted on the paper roll supporting device in such a manner as to be rotatable around the rotating shaft center, an attitude holding means for holding the rack in a predetermined attitude by preventing the rack from rotating together with the paper roll supporting device, and a new paper roll accelerating device for driving and rotating the paper roll by causing a driven accelerating roller mounted on a supporting member to rotate by a driving accelerating roller rotated by a variable speed control motor (paper roll driving motor) mounted on the rack; the second apparatus being adapted to rotate the paper roll via the supporting members by supporting the paper roll by causing the paper roll supporting device to move along the rotating shaft in accordance with the width and the loading position of the paper roll, and causing the new paper roll accelerating device mounted on the paper roll supporting device via the rack to move along with the paper roll supporting device without changing the relative positions of the driving accelerating roller and the driven accelerating roller mounted on the supporting member and to operate at the position after being moved by bringing the driving accelerating roller (or driving accelerating gear) and the driven accelerating roller (or driven accelerating gear) into contact (or into mesh) with each other.

An apparatus disclosed in Japanese Published Examined Patent Application No. Hei-6(1994)-78136 comprises a drive source mounted on the outside of a frame, a paper roll support supported by a rotating shaft rotatably together with the rotating shaft; the paper roll support adapted so as to support both sides of a paper roll via a supporting member having a toothed pulley and move along a rotating shaft, and a paper roll driving mechanism comprising a sub frame supported by a guide lever provided in parallel with the rotating shaft in such a manner as to move along the guide lever by the telescopic motion of the rod of a hydraulic cylinder provided in parallel with the guide lever, a driving shaft connected to the sub frame in parallel with the rotating shaft and rotatably, while passing through one of the sub frame and the frame, in such a manner as to be rotated by the drive source, an arm provided on the driving shaft in such a manner as to pivot around the driving shaft center and having a double-side toothed timing belt driven by the drive source via the driving shaft provided between a driving-side toothed pulley provided on the driving shaft and a pivoting-side toothed pulley provided on the pivoting side, and a hydraulic cylinder for pivoting the arm, the apparatus adapted to support a paper roll by causing the paper roll support to move along the rotating shaft in accordance with the width of the paper roll and to move the position of the paper roll driving mechanism in accordance with the movement of the paper roll support until the position of the paper roll support agrees with the position of the toothed pulley provided on the support member by causing the sub frame to move along the guide lever by the telescopic motion of the rod of the hydraulic cylinder, so that the paper roll is caused to rotate via the support member by operating the paper roll driving mechanism by engaging the double-face toothed timing belt with the toothed pulley provided on the support member.

The first apparatus disclosed in Japanese Published Examined Patent Application No. Sho-63(1988)-48785 had a problem as mentioned in that document. That is, as the paper roll supporting device is caused to move along the rotating shaft to load a new paper roll having a different paper width, the driven accelerating roller mounted on the paper roll supporting device via the supporting member is also caused to move. For this reason, the rack, the paper roll driving motor mounted on the rack and the new paper roll accelerating device including the driving accelerating roller have had to be moved to the position of the driven accelerating roller mounted on the paper roll supporting device via the supporting member. This moving operation, however, has had to be carried out manually by an operator, requiring a lot of time in printing preparation. Alignment of the driving accelerating roller and the driven accelerating roller has also been troublesome, and a large misalignment could cause a slip of the driving accelerating roller or a damage to it, causing a trouble in paper roll splicing, adversely affecting printing operation.

The second apparatus disclosed in Japanese Published Examined Patent Application No. Sho-63(1988)-48785 was conceived to overcome the aforementioned problem with the first apparatus. In the second apparatus having such a construction that the rack is mounted on the paper roll supporting device supported by the rotating shaft, and the variable-speed control motor (paper roll driving motor) and the new paper roll accelerating device for rotating the paper roll by rotating the driven accelerating roller mounted on the supporting member by the driving accelerating roller driven by the variable-speed control motor are provided on the rack, however, the rack incorporating the variable-speed control motor has had to be mounted on the paper roll supporting device. For this reason, the paper roll supporting device of the second apparatus has tended to become larger in size in the axial direction of the rotating shaft, and the load-bearing span of the rotating shaft also has tended to become larger. Thus, an increased load on the rotating shaft has caused a larger deflection on the rotating shaft, leading to an offset of a paper web paid out from the paper roll. Offsets or wrinkles of the paper web not only cause troubles in printing operation, but also adversely affect printing quality.

In the apparatus disclosed in Japanese Published Examined Patent Application No. Hei-6(1994)-78136, when the paper roll support is moved along the rotating shaft to load a paper roll having a different roll width, the toothed pulley provided on the supporting member of the paper roll support is also moved. For this reason, the sub frame and the paper roll driving mechanism mounted thereon have had to be aligned with the position of the toothed pulley provided on the supporting member by operating the hydraulic cylinder. Movement of the paper roll driving mechanism by the hydraulic cylinder, however, is limited by the telescopic stroke of the hydraulic cylinder rod. For this reason, the moving position of the paper roll support has had to be accurately set, and this position alignment has been a troublesome operation. In addition, too large a misalignment could have led to a damage to teeth due to insufficient engagement, or failure of engagement, between the double face toothed timing belt of the paper roll driving mechanism and the toothed pulley mounted on the supporting member. Such troubles have adversely affected paper roll splicing and the overall printing operation. Moreover, this apparatus has not been able to accommodate a paper roll of a predetermined width only at a predetermined position in the axial direction of the rotating shaft due to the fixed telescopic stroke of the hydraulic cylinder rod. Furthermore, since the driving shaft movable together with the sub frame has to be always connected to the drive source mounted on the outside of the frame, the driving shaft has required an extra length as long as the telescopic stroke of the hydraulic cylinder rod, and a special shape such as a spline or castellated shape, leading to an increased cost.

SUMMARY OF THE INVENTION

It is an object of the present invention to provide a paper roll driving apparatus that requires less time for printing preparation as a result of eliminating the manual operation for positioning a driven mechanism for transmitting rotation to a paper roll supported by paper roll supports and a driving transmission mechanism that can be connected to the driven mechanism, and eliminating the need for accurately setting the position of the paper roll support, even when the paper roll supports are caused to move so as to load a paper roll of a different width, that eliminates troubles in paper roll splicing by preventing misalignment between the driven mechanism and the driving transmission mechanism, thereby ensuring the positive rotation of the paper roll, and that eliminates troubles in printing operation due to offsets or wrinkles on the travelling paper web paid out from the paper roll by reducing the supporting span of the rotating shaft and the load on the rotating shaft, thereby preventing the deflection of the rotating shaft.

It is another object of the present invention to provide a paper roll driving apparatus that can load paper rolls of different widths at a desired position in the axial direction of the rotating shaft, thereby rotating a paper roll without trouble, and that can be manufactured at a low cost.

It is still another object of the present invention to provide a paper roll driving apparatus that can prevent possible troubles caused when the driving transmission mechanism is moved in accordance with the movement of the paper roll support, such as sagging or tangles of power cables for feeding power to the prime mover of the driving transmission mechanism.

It is a further object of the present invention to provide a paper roll driving apparatus in which the driven mechanism and the driving transmission mechanism are connected to each other with the increased contact surface area of both so as to more positively rotate the paper roll and distribute the load exerted on the contact area between both, thereby preventing the driven mechanism and the driving transmission mechanism from being damaged due to overload.

The present invention has such a construction that, in a paper roll driving apparatus for use in paper roll feeding apparatus comprising paper roll supports that are supported facing each other on a rotatable driven rotating shaft and can be moved along the rotating shaft and fixed at a desired position, at least a pair of support members that are provided facing each other on the paper roll supports and can be rotated around a rotating center line parallel to the axial center of the rotating shaft, a driven mechanism provided on each of the supporting member of at least any one of the paper roll supports, and a driving transmission mechanism that can be connected to the driven mechanism; wherein the paper roll being supported in parallel with the rotating shaft by the paper roll support via the support members; the support members being rotated by connecting the driven mechanism to the driving transmission mechanism; and the paper roll being rotatably provided via the support members, a prime mover moving mechanism having a guide rail provided in parallel with the rotating shaft and a moving body that can be reciprocated freely along the guide rail and has a prime mover mounted thereon, and the moving body being connected to the paper roll supports and adapted to be movable in the direction parallel to the rotating shaft in accordance with the movement of the paper roll supports along the rotating shaft; and a driving transmission mechanism having a relay shaft rotatably provided on the moving body in parallel with the rotating shaft, an arm mounted on the moving body in such a manner as to be pivotable along the axial center of the relay shaft, and a pivoting means are provided, wherein both the prime mover and the driving transmission mechanism being integrally movable, together with the paper roll supports, in parallel with the rotating shaft.

Furthermore, the present invention has such a construction that, in a paper roll driving apparatus for use in paper roll feeding apparatus comprising paper roll supports that are supported facing each other on a rotatable driven rotating shaft and can be moved along the rotating shaft and fixed at a desired position, at least a pair of support members that are provided on the paper roll supports facing each other and can be rotated around a rotating center line parallel to the axial center of the rotating shaft, a driven mechanism provided on each of the supporting member of at least any one of the paper roll supports, and a driving transmission mechanism that can be connected to the driven mechanism; the paper roll being supported in parallel with the rotating shaft by the paper roll support via the support members; the support members being rotated by connecting the driven mechanism to the driving transmission mechanism; and the paper roll being rotatably provided via the support members, a prime mover moving mechanism having a guide rail provided in parallel with the rotating shaft and a moving body that can be reciprocated freely along the guide rail and has a prime mover mounted thereon, and the moving body being connected to the paper roll supports and adapted to be movable in the direction parallel to the rotating shaft in accordance with the movement of the paper roll supports along the rotating shaft; a cable supporting mechanism for supporting between both ends thereof a power feeding cable where a plurality of links are connected in such a manner as to be bendable only in one direction, with one end thereof fitted to the moving body, the links bent between both ends, the other end thereof fixedly fitted to a part in the middle or vicinity of the moving range of the moving body; and a driving transmission mechanism comprising a relay shaft rotatably provided on the moving body in parallel with the rotating shaft, an arm mounted on the moving body in such a manner as to be pivotable around the axial center of the relay shaft and having a transmission part that is driven by the prime mover via the relay shaft, and a pivoting means, wherein both the prime mover and the driving transmission mechanism adapted to be integrally movable, together with the paper roll support, in parallel with the rotating shaft.

With the aforementioned construction, the following operations can be expected. That is, in the present invention, the paper roll support is moved along the rotating shaft to load paper rolls of different widths. Along with this movement, the driven mechanism is also moved via the support members provided on the paper roll support. Furthermore, as the moving body connected to the paper roll support is moved by the same distance and in the same direction as the paper roll support along the guide rail provided in parallel with the rotating shaft, the prime mover fitted to the moving body is also moved in a similar manner. With this movement, the power feeding cable to the prime mover is moved while supported by the cable supporting mechanism as the cable supporting mechanism is bent.

As the moving body is moved, on the other hand, the transmission part of the driving transmission mechanism is moved by the same distance and in the same direction as the paper roll support via the arm mounted on the moving body, with the result that no misalignment is caused in the axial direction of the rotating shaft between the driven mechanism and the transmission part of the driving transmission mechanism.

The pivoting means of the driving transmission mechanism is actuated at the position after the movement, causing the arm to pivot at a predetermined angle to connect the transmission part to the driven mechanism. That is, the double-face toothed belt as the transmission part is caused to make contact with the toothed pulley of the driven mechanism, engaging the teeth of both with each other.

As the transmission part is connected to the driven mechanism, the prime mover is actuated to cause the transmission part to rotate via the relay shaft, thereby causing the paper roll to rotate via the driven mechanism and the supporting members making contact with the transmission part.

DETAILED DESCRIPTION OF THE PREFERRED EMBODIMENTS

Now, embodiments of the present invention will be described in the following, referring to the accompanying drawings.

Figure 1:
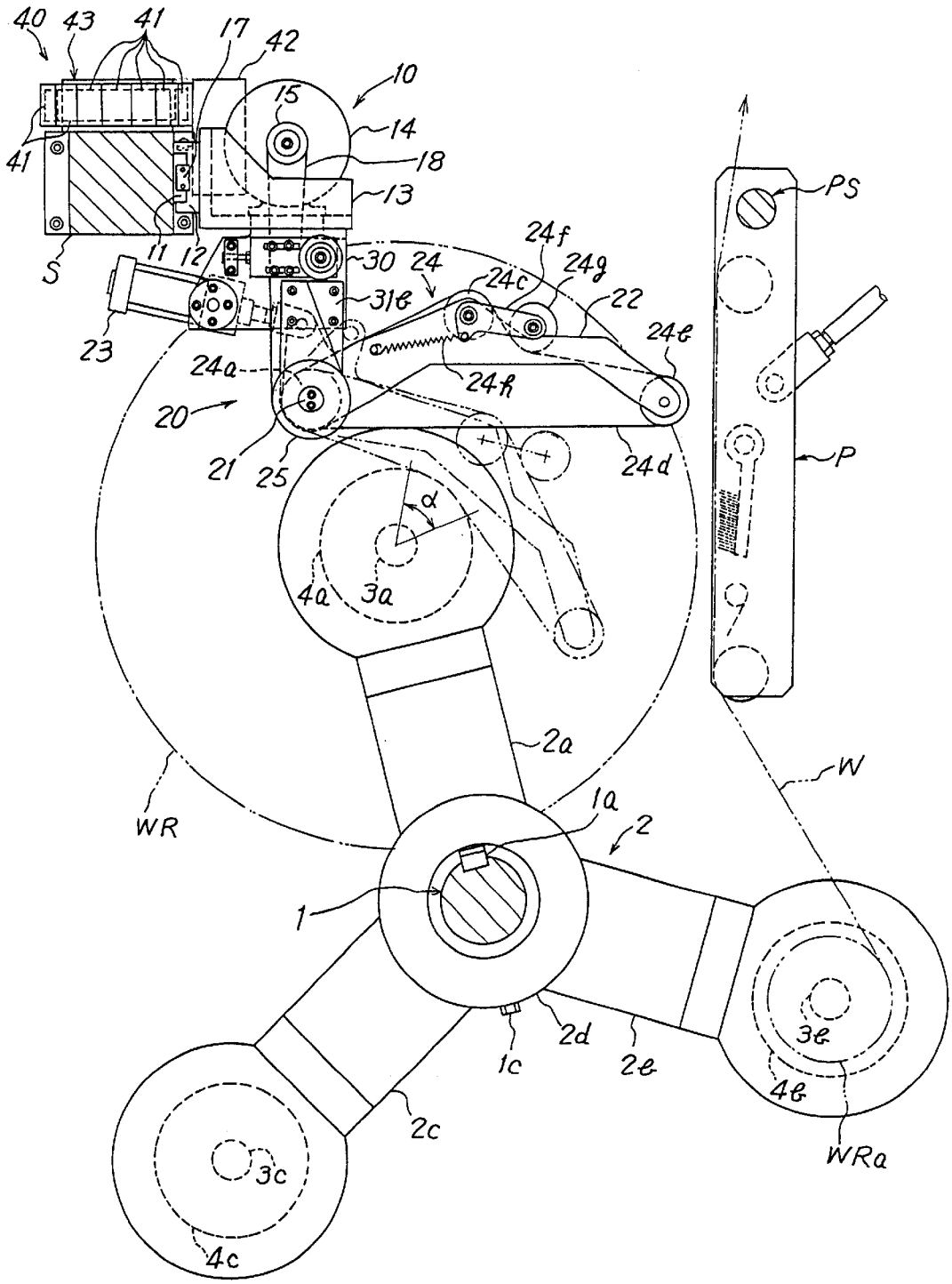
FIG. 1 is a front view, taken in the direction of the arrows substantially along the line I—I of FIG. 2, illustrating the essential part of an example of the paper roll feeding apparatus having a paper roll driving apparatus embodying the present invention.
Figure 2:
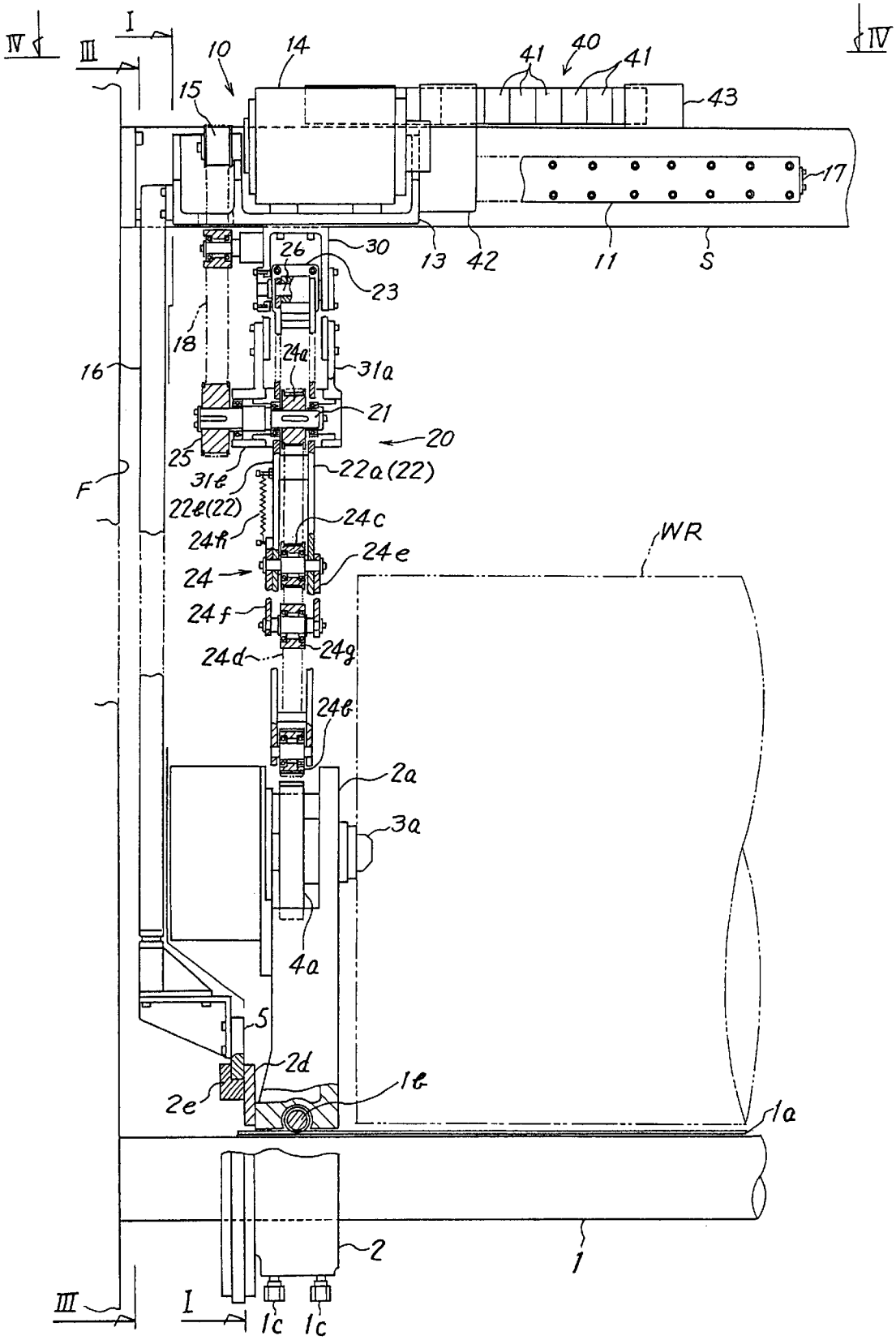
FIG. 2 is a fragmentally cross-sectional development of an example of the paper roll feeding apparatus having the paper roll driving apparatus according to the present invention.
Figure 3:
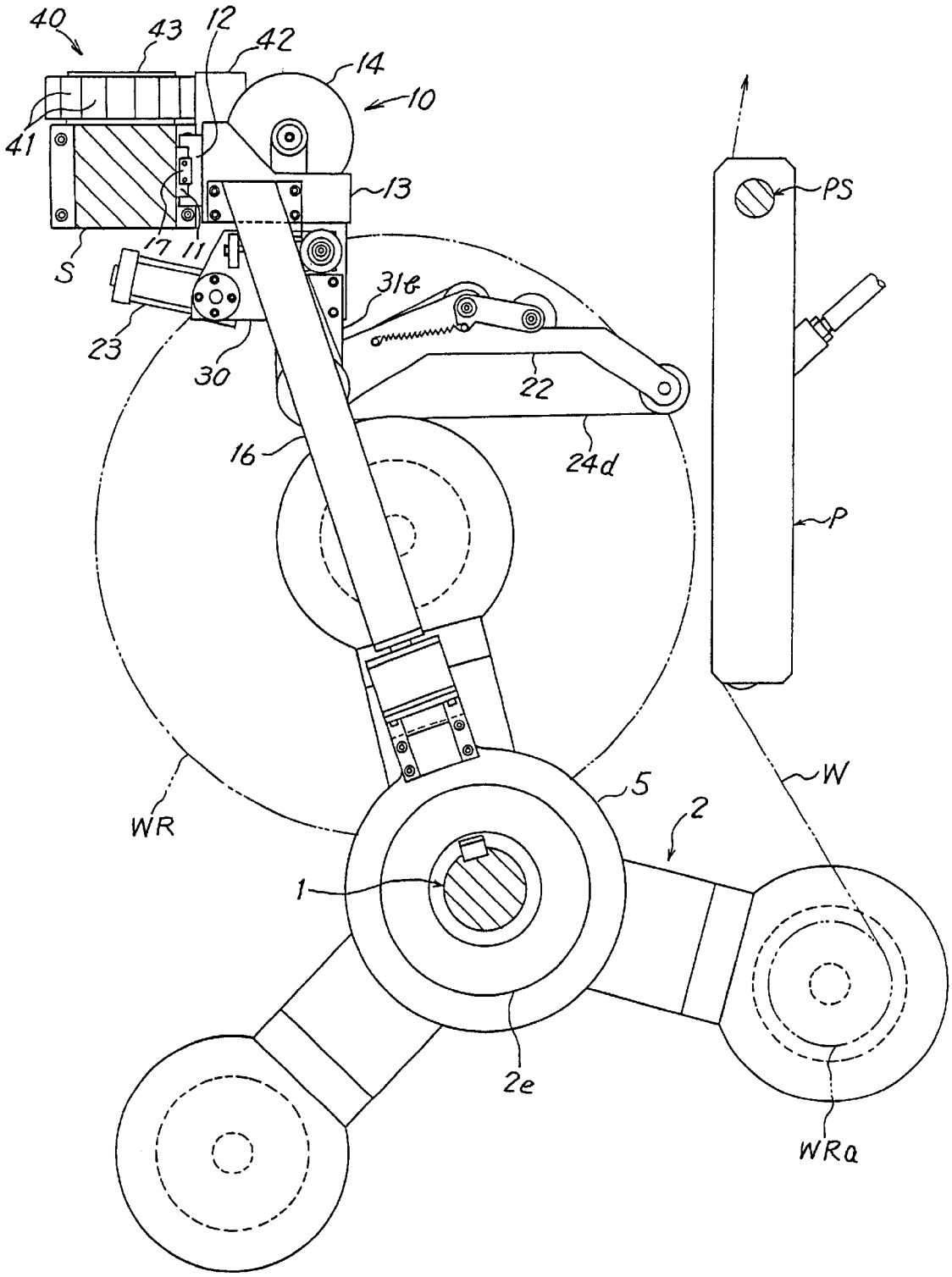
FIG. 3 is a view taken in the direction of the arrows substantially along the line III—III of FIG. 2.
Figure 4:
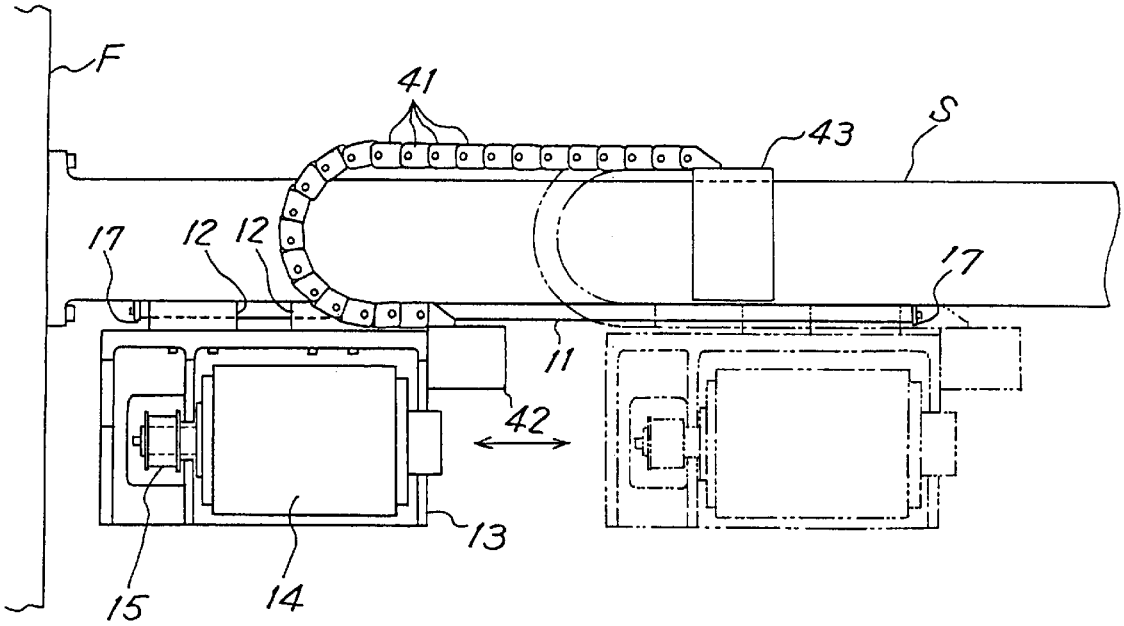
FIG. 4 is a view taken in the direction of the arrows substantially along the line IV—IV of FIG. 2.

FIG. 1 is a front view, taken in the direction of the arrows substantially along the line I—I of FIG. 2, illustrating the essential part of an example of the paper roll feeding apparatus having a paper roll driving apparatus embodying the present invention, FIG. 2 is a fragmentally cross-sectional development of an example of the paper roll feeding apparatus having the paper roll driving apparatus according to the present invention, FIG. 3 is a view taken in the direction of the arrows substantially along the line III—III of FIG. 2, and FIG. 4 is a view taken in the direction of the arrows substantially along the line IV—IV of FIG. 2.

In FIG. 1, reference numeral 1 denotes a rotating shaft rotatably supported by opposing frames F and F (refer to FIG. 2, in which only one of them is shown) and driven by a drive means (not shown). On the rotating shaft 1 provided are a pair of paper roll supports 2 and 2 (only one of them is shown in the figure) facing each other in such a manner that a paper roll WR can be loaded. The paper roll support 2 has three arms 2*a*, 2*b* and 2*c* extending radially in three equally spaced directions around the axial center of the rotating shaft 1. The arms 2*a*, 2*b* and 2*c* have supporting members 3*a*, 3*b* and 3*c*, respectively, disposed at positions equidistant from the axial center of the rotating shaft 1; the supporting members 3*a*, 3*b* and 3*c* on the opposing paper roll supports 2 and 2 facing each other on the axial line parallel to the axial center of the rotating shaft 1. The paper roll support 2 is adapted so as to be rotatable in accordance with the rotation of the rotating shaft 1 via a key 1*a*, and so as to be movable along the rotating shaft 1 to adjust the opposing supporting members 3*a* and 3*a*, or 3*b* and 3*b*, or 3*c* and 3*c* (only one of them shown in the figure) to the width of the paper roll WR supported between a pair of the paper roll supports 2 and 2 by loosening the fixing bolts 1*c* and 1*c* and rotating the shaft (not shown) of a pinion 1*b* (see FIG. 2) engaged with a rack formed on the upper surface of the key 1*a* by an appropriate tool or prime mover (both not shown). It is also possible to fixedly fitted the moved paper roll support 2 at the position after the movement by tightening the fixing bolts 1*c* and 1*c*.

Driven toothed pulleys 4*a*, 4*b* and 4*c* as the driven mechanism are provided on the supporting members 3*a*, 3*b* and 3*c*, respectively, so as to be rotatable together with the corresponding supporting members 3*a*, 3*b* and 3*c*.

A stay S is provided between the frames F and F disposed at positions apart from the axial center of the rotating shaft 1 by a distance exceeding the maximum diameter of the paper roll WR supported by the paper roll supports 2 and 2. A prime mover moving mechanism 10 is provided on the stay S.

The prime mover moving mechanism 10 comprises a guide rail 11 provided on the stay S in parallel to the rotating shaft 1, a moving body 13 mounted on the guide rail 11 via moving blocks 12 and 12 in such a manner as to be reciprocally movable freely among the guide rail 11, a prime mover 14 provided on the moving body 13, a driving toothed pulley 15 provided on the output shaft of the prime mover 14, a connecting body 16 (see FIGS. 2 and 3) for connecting the paper roll support 2 to the moving body 13, and stoppers 17 and 17 each provided on both ends of the guide rail 11; the prime mover moving mechanism 10 adapted so as to be movable along the guide rail 11 in accordance with the movement of the paper roll support 2 along the rotating shaft 1 through the operation of the shaft of the pinion 1*b*. One end of the connecting body 16 is fitted to the moving body 13 and the other end thereof to the paper roll support 2. A sliding member 5 is provided on an annular groove formed by the auxiliary members 2*d* and 2*e* integrally fitted to the paper roll support 2 on the side surface of the paper roll support 2 in such a manner as to be rotatable around the axial center of the rotating shaft 1.

A driving transmission mechanism 20 is provided on the moving body 13.

The driving transmission mechanism 20 comprises a bell crank arm 22 comprising a relay shaft 21 rotatably provided on brackets 31*a* and 31*b* mounted on the moving body 13 via a bracket 30 and two sheet members 22*a* and 22*b* opposing at a predetermined interval, with the longer side of the L-shaped arm formed into an upwardly arched shape, and adapted in such a manner as to be pivotable around the axial center of the relay shaft 21, a pivoting means 23 connected to the end of the shorter side of the L-shaped arm in such a manner as to cause the bell crank arm 22 be pivoted around the axial center of the relay shaft 21, and a transmission part 24 provided between the two sheet members 22*a* and 22*b* of the bell crank arm 22.

The transmission part 24 comprises a first toothed pulley 24*a* provided between the sheet members 22*a* and 22*b* in such a manner as to be rotatable integrally with the relay shaft 21, a second toothed pulley 24*b* rotatably provided between the sheet members 22*a* and 22*b* at the end of the longer side of the L-shaped arm of the bell crank arm 22, a third toothed pulley 24*c* rotatably provided between the sheet members 22*a* and 22*b* at the center of the longer side of the L-shaped arm of the bell crank arm 22, an endless double-face toothed belt 24*d* connecting the first, second and third toothed pulleys 24*a*, 24*b* and 24*c*, and a belt tightening pulley 24*g* provided at free ends of sheet members 24*e* and 24*f*, adjacent to the sheet members 22*a* and 22*b*, in such a manner as to be pivotable around the axial center of the third toothed pulley 24*c* by the tension of a spring 24*h*. The transmission part 24 is provided in such a manner that the position of the transmission part 24 in the direction parallel to the rotating shaft 1 matches with the positions of the driven toothed pulleys 4*a*, 4*b* and 4*c* mounted on the paper roll support 2 via the supporting members 3*a*, 3*b* and 3*c*, and that the endless double-face toothed belt 24*d* is prevented from loosening by the tension of the spring 24*h* acting via the belt tightening pulley 24*g*.

The driving transmission mechanism 20 has such a construction that the middle part thereof is supported by the bracket 30 in such a manner as to be pivotable at a predetermined angle, and that an end of the telescopic rod of the pivoting means 23 (an air cylinder, for example) is connected to the bell crank arm 22 via a pin 26 in such a manner as to be pivotable at a predetermined angle. With the extension of the telescopic rod, the bell crank arm 22 pivots in such a manner that the longer side end of the L-shaped arm of the bell crank arm 22 descends. With the angular movement of the bell crank arm 22, the outer side surface of the endless double-face toothed belt 24*d* stretched like a chord between the first and second toothed pulleys 24*a* and 24*b* on the longer side of the L-shaped arm of the bell crank arm 22 makes contact with a range corresponding to a predetermined central angle $\alpha$ of the outer circumferential surface of the driven toothed pulley 4*a* (or 4*b* or 4*c*) as the driven mechanism provided on the supporting member 3*a* (or 3*b* or 3*c*) supporting the paper roll WR that has been moved to a splicing position by the rotation of the rotating shaft 1 (as shown by chain lines in FIG. 1). With this contact, teeth of the endless double-face toothed belt 24*d* mesh with the teeth of the driven toothed pulley 4*a* (or 4*b* or 4*c*). The driving transmission mechanism 20 has a relay toothed pulley 25 provided on an end protruding from the bracket 31*b* of the relay shaft 21 in such a manner as to rotate integrally with the relay shaft 21. The relay toothed pulley 25 is connected to the driving toothed pulley 15 provided on the output shaft of the prime mover 14 via the endless toothed belt 18 so that the relay shaft 21 is driven by the prime mover 14.

Moreover, the stay S has a cable supporting mechanism 40 supporting a power cable (not shown) for feeding power to the prime mover 14 movably mounted on the moving body 13.

The cable supporting mechanism 40 is such that a plurality of link-shaped members 41, 41, - - - , such as Runner Flex (brand name) made by Igus Japan K.K., are connected in such a manner as to be bendable only in one direction into a chain inside which a power cable can be supported; with one end thereof connected to a terminal box 42 provided on the prime mover moving mechanism 10 in such a manner as to be movable parallel with the rotating shaft 1, together with the prime mover 14 and folded back at a predetermined radius, and the other end connected to a terminal box 43 provided on the top surface of the stay S. Power is fed to the prime mover 14 via the terminal box 43, the power cable supported by the cable supporting mechanism 40 and the terminal box 42. The terminal box 43 is typically provided almost in the middle of the moving range of the terminal box 42.

Next, the operation of the present invention having the aforementioned construction will be described in the following.

As a paper roll WRa is consumed with the progress of printing operation, with the diameter thereof getting smaller than a predetermined first diameter, the paper roll feeding apparatus starts the splicing mode where the leading edge of a new paper roll WR to the traveling web W paid out from the paper roll WRa.

In the splicing mode, the rotating shaft 1 is driven by a drive means (not shown), causing the paper roll support 2 to move to a splicing position as shown in FIG. 1, for example. During this movement, the sliding member 5 (see FIG. 2) to which the connecting body 16 is fitted slides around the outer circumferential surface of the smaller diameter part of the auxiliary member 2*e* with a groove formed by the auxiliary members 2*d* and 2*e*, and holds the attitude thereof. A splicing device P pivots around a fulcrum PS, moving to a ready-to-splice position.

As the diameter of the paper roll WRa reaches a predetermined further smaller second diameter, the telescopic rod of the pivoting means 23 of the driving transmission mechanism 20 extends, causing the bell crank arm 22 to pivot around the axial center of the relay shaft 21, causing the longer side end of the L-shaped arm to descend to a position shown by chain double-dashed lines in FIG. 1. With this angular movement of the bell crank arm 22, the endless double-face toothed belt 24*d* at the position corresponding to the chord on the longer side of the L-shaped arm of the bell crank arm 22 makes contact with the range corresponding to a predetermined central angle $\alpha$ on the outer circumferential surface of the driven toothed pulley 4*a* mounted on the supporting member 3*a* supporting the paper roll WR, causing the teeth provided on the outside surface of the endless double-face toothed belt 24*d* to mesh with the teeth provided on the outer circumferential surface of the driven toothed pulley 4*a*. The central angle $\alpha$ is set to a range from 20 degrees to 70 degrees, for example.

Upon completion of the angular movement of the bell crank arm 22, the prime mover 14 begins rotation. As the prime mover 14 begins rotation, the relay shaft 21 is driven and rotated via the driving toothed pulley 15, the endless toothed belt 18 and the relay toothed pulley 25 provided on the output shaft thereof. The rotation of the relay shaft 21 is transmitted to the transmission shaft 24 via the first toothed pulley 24*a* that rotates integrally with the relay shaft 21. That is, the force exerted by the pivoting means 23 causes the endless double-face toothed belt 24*d* tightly stretched over the first toothed pulley 24*a*, the second toothed pulley 24*b*, the third toothed pulley 24*c* and the driven toothed pulley 4*a* to rotate. The rotation of the endless double-face toothed belt 24*d* is transmitted to the driven toothed pulley 4*a* meshed therewith, causing the driven toothed pulley 4*a* to rotate, causing the paper roll WR to rotate via the supporting member 3*a* that rotates integrally with the driven toothed pulley 4*a*.

After the peripheral speed of the paper roll WR agrees with the traveling speed of the traveling web W paid out from the paper roll WRa, the splicing device P is actuated to start splicing.

When a paper roll of a different width is needed for the next printing operation after the completion of the preceding printing operation, the paper roll of the width to be used in the next printing operation is loaded on the paper roll support 2.

That is, after the paper roll used in the preceding printing operation has been removed, the paper roll support 2 is moved along the rotating shaft 1 to accommodate the width of the paper roll being loaded by loosening the fixing bolts 1*c* and 1*c* and rotating the shaft of the pinion 1*b*. When the paper roll support 2 has been moved to a desired position, the fixing bolts 1*c* and 1*c* are tightened to fixedly fit the paper roll support 2.

With the movement of the paper roll support 2, the supporting members 3*a*, 3*b* and 3*c* rotatably provided each on free ends of the arms 2*a*, 2*b* and 2*c* of the paper roll support 2, and the driven toothed pulleys 4*a*, 4*b* and 4*c* provided on the supporting members 3*a*, 3*b* and 3*c* are moved parallel with the rotating shaft 1.

The moving body 13 of the prime mover moving mechanism 10 connected to the paper roll support 2 via the auxiliary members 2*d* and 2*e*, the sliding member 5 and the connecting body 16 is also moved parallel with the rotating shaft 1. That is, the moving body 13 moves the same distance in the same direction, together with the moving blocks 12 and 12, along the guide rail 11 as the paper roll support 2 moves. The movement of the moving blocks 12 and 12 along the guide rail 11 is protected against overrun by the stoppers 17 and 17 provided on both ends of the guide rail 11. As the moving body 13 moves, the prime mover 14 mounted on the moving body 13 also moves. The driving transmission mechanism 20 mounted on the moving body 13 via the bracket 30 and the brackets 31*a* and 31*b* also moves the same distance in the same direction.

As a result, the paper roll driving device for driving the paper roll loaded on the paper roll support 2 can also be moved simultaneously merely by moving the paper roll support 2, while there is no change in relative positions in the direction parallel to the rotating shaft 1 between the driven toothed pulleys 4*a*, 4*b* and 4*c* and the transmission part 24 of the driving transmission mechanism 20 of the paper roll driving apparatus.

Moreover, the cable supporting mechanism 40 for supporting the power cable for feeding power to the prime mover 14 is deformed from a J shape to U shape and then to an inverted J shape along with the movement of the moving body 13, while supporting the power cable in the inside thereof without interfering with the movement of the moving body 13 and preventing the cable from unwantedly loosening.

As is apparent from the description above, the present invention has the following effects:

That is, when the paper roll support is moved to adjust to the width of a paper roll being loaded, both the driven mechanism transmitting rotation to the paper roll and the driving transmission mechanism transmitting a drive force thereto do not have to be realigned, and there can be no misalignment caused between both, since they are moved the same distance and in the same direction. As a result, the time for printing preparation can be reduced, leading to improved printing efficiency. In addition, the paper roll can be positively driven and rotated, eliminating the fear of causing troubles in splicing. Moreover, as neither of the supporting span of the rotating shaft nor the load to the rotating shaft increases, the deflection of the rotating shaft does not increase, there is no likelihood of offsets or wrinkles on the traveling web paid out of the paper roll. This eliminates the fear of causing troubles in printing operation, leading to improved printing efficiency. Furthermore, no limitations are imposed on the width of a paper roll being loaded and the paper roll loading position in the axial direction of the rotating shaft, resulting in reduced manufacturing cost.

With the present invention, the fear of the power cable for the prime mover interfering with the driving transmission mechanism which moves along with the movement of the paper roll support is eliminated. Thus, unwanted printing preparation time can be eliminated.

With the present invention where the load to the contact portion of the driven mechanism and the driving transmission mechanism is distributed, the fear of damage to the driven mechanism and the driving transmission mechanism due to overload can be eliminated.

What is claimed is:

1. A roll driving apparatus comprising:

a frame;

a roll shaft rotatably mounted on said frame and including a roll support axially movable on said roll shaft, said roll support having a plurality of aims rotatably supportable of a plurality of rolls, said roll support being rotatable with said roll shaft to move the rolls into different positions;

a guide rail mounted on said frame and arranged substantially parallel to said roll shaft;

a drive mechanism movably mounted on said guide rail and selectively connectable to said arms of said roll support to rotate a roll held by a respective said arm about an axial axis of the respective roll;

a connecting body axially fixing said drive mechanism and said roll support together to cause said drive mechanism and said roll support to axially move together along said guide rail and said roll shaft.

2. An apparatus in accordance with claim 1, wherein:

each of said arms of said roll support include an arm pulley rotatably mounted on a respective said arm and rotatable of a respective connected roll;

said drive mechanism includes a bracket slidably connected to said guide rail, said drive mechanism also includes a drive arm pivotally connected to said bracket, said drive mechanism includes an arm belt rotatable around said drive arm, said drive arm being pivotal on said bracket to move said belt into and out of operational contact with said arm pulleys of said arms, said drive mechanism includes a motor mounted on said bracket and a bracket bet connected to said motor and said arm belt, rotation of said motor rotating said bracket belt, said arm belt and said arm pulley to rotate the respective connected roll.

3. An apparatus in accordance with claim 1, further comprising:

a splicing device arranged adjacent one of the rolls held by one of said arms connected to said drive mechanism, said splicing device connecting a web from another one of the rolls to a web of the one roll.

4. An apparatus in accordance with claim 1, further comprising:

another roll support spaced apart from said roll support on said roll shaft, said roll support being axially movable toward and away from said second roll support on said roll shaft, said another roll support having a plurality of arms rotatably supportable of the plurality of rolls, said another roll support being rotatable with said roll shaft to move the rolls into different positions.

* * * * *